US008739754B2

(12) United States Patent
Yan

(10) Patent No.: US 8,739,754 B2
(45) Date of Patent: Jun. 3, 2014

(54) ACCOMMODATING PISTON SEAT FOR DIFFERENTIAL-STROKE CYCLE ENGINES

(75) Inventor: Miin Jeng Yan, Dublin, OH (US)

(73) Assignee: Yan Engines, Inc., Austin, TX (US)

( * ) Notice: Subject to any disclaimer, the term of this patent is extended or adjusted under 35 U.S.C. 154(b) by 87 days.

(21) Appl. No.: 13/146,706

(22) PCT Filed: Feb. 4, 2010

(86) PCT No.: PCT/US2010/023248

§ 371 (c)(1),
(2), (4) Date: Jul. 28, 2011

(87) PCT Pub. No.: WO2010/093560

PCT Pub. Date: Aug. 19, 2010

(65) Prior Publication Data

US 2011/0283963 A1 Nov. 24, 2011

Related U.S. Application Data

(60) Provisional application No. 61/207,280, filed on Feb. 11, 2009.

(51) Int. Cl.
*F02B 75/32* (2006.01)

(52) U.S. Cl.
USPC ..... 123/193.6; 123/48 AA; 123/78 AA; 123/78 B

(58) Field of Classification Search
USPC ..... 123/193.6, 78 B, 78 AA, 48 B, 48 AA
See application file for complete search history.

(56) References Cited

U.S. PATENT DOCUMENTS

| | | | | |
|---|---|---|---|---|
| 857,410 | A | 6/1907 | Morey | |
| 1,413,541 | A | 4/1922 | Reed | |
| 1,437,757 | A | 12/1922 | Hutchinson | |
| 1,568,964 | A | 1/1926 | Douglas | |
| 1,582,890 | A | 5/1926 | Ashley et al. | |
| 2,402,798 | A | 6/1946 | Woodall | |
| 4,515,114 | A | 5/1985 | Dang | |
| 5,243,938 | A | 9/1993 | Yan | |
| 5,755,192 | A * | 5/1998 | Brevick | 123/78 B |
| 6,223,703 | B1 | 5/2001 | Galvin | |
| 7,146,940 | B2 * | 12/2006 | Knutsen | 123/48 B |
| 7,527,025 | B2 * | 5/2009 | Kadota et al. | 123/48 R |

FOREIGN PATENT DOCUMENTS

CN 101000018 A 7/2007

OTHER PUBLICATIONS

International search report and written opinion dated Mar. 31, 2010 for PCT/US2010/023248.

* cited by examiner

*Primary Examiner* — M. McMahon

(74) *Attorney, Agent, or Firm* — Lloyd Lee Davis; Andrews Kurth LLP

(57) ABSTRACT

A piston seat method and apparatus for a differential-stroke cycle combustion engine, the combustion engine including one or more two-part pistons, each two-part piston having a first piston part and a second piston part. The apparatus comprising: a piston seat cover operatively associated with the first piston part, the piston seat cover being adapted for abutting engagement with the second piston part; wherein, upon abutting engagement, the seat cover is adapted to move relative to the first piston part, thereby at least partially absorbing impact forces applied between the first piston part and the second piston part.

17 Claims, 4 Drawing Sheets

ACCOMMODATING PISTON SEAT FOR DIFFERENTIAL-STROKE CYCLE ENGINES

FIELD OF THE INVENTION

The present invention relates to combustion engines and in particular to differential-stroke cycle combustion engines.

The invention has been developed primarily for use as an accommodating piston seat apparatus for a differential-stroke cycle combustion engine, and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Conventional internal combustion engines have at least one cylinder, a piston in the cylinder, and a crankshaft driven by the piston. Most of these engines operate on a four stroke cycle of the piston per two revolutions of the crankshaft. During the cycle, the piston's strokes are first outward for intake, first inward for compression, second outward (after ignition) for combustion and power, and second inward for exhaust. The burnt gas is driven out during the exhaust stroke and a fresh charge is drawn in during the intake stroke. These two strokes require little force and the piston is subject to low pressures. These two strokes also require one entire revolution of the crankshaft for these purposes.

More output could be obtained from a four stroke engine of a given displacement if it could complete its cycle in only one revolution of the crankshaft. There are conventional two-stroke engines in which the four functions of combustion, exhaust, intake and compression, are crammed into two strokes of the piston per one revolution of the crankshaft. Such two-stroke engines generally weigh less than four-stroke engines but are generally less fuel efficient than four-stroke engines, and hence are conventionally used only in certain special fields, such as small garden engines.

There is a way to combine the advantages of four strokes of the piston with the advantage of one revolution of the crankshaft per cycle and that is to split the piston into an inner part which closes one end of the combustion chamber and a separable outer part which is connected to the crankshaft, and to provide means to move the inner piston part independently of the outer piston part during exhaust and intake. This provides for the inner piston part to operate on the four-stroke principle during a single revolution of the crankshaft.

U.S. Pat. No. 857,410 discloses that a quarter revolution of meshed gearing can be used to operate the piston parts in their different cycles. This design has many problems such as gnashing of teeth when the two gears engage on each revolution of the drive shaft, and a complicated gearing system that is fixed at a four to one ratio that divides the four strokes in equal lengths and periods.

U.S. Pat. No. 1,413,541 discloses a split piston having a four stroke inner piston part and a two stroke outer piston part (per cycle or engine revolution). There is also provided an inner piston part that has a cycle with a period for each stroke that is exactly 90 degrees and equal to half the period of a stroke of the outer piston which is 180 degrees. Another limitation of the apparatus includes equal stroke lengths or piston travel for the four strokes of the inner piston part.

U.S. Pat. Nos. 857,410 and 1,413,541 each disclose drive connections for the part of the piston that closes the combustion chamber so that it must move in four equal strokes, each completed during a quarter turn (90 degrees).

U.S. Pat. No. 1,582,890 discloses two pistons in a cylinder, which close two chambers. Operating not on a four stroke principle, it uses a cam actuation means to move the inner piston between the two chambers and two sets of ports generally located at opposite ends of its stroke along the cylinder wall. This is to allow the inner piston to pressurize the outer chamber on its downward stroke, which takes a lot of power and strength requiring its actuating apparatus to be unnecessarily heavy and bulky in structure. Furthermore, the outer ports on the cylinder wall limit the inner piston to equal stroke lengths and symmetrical periods. This patent teaches cylinder ports which the inner piston must cover during combustion and final compression of the combined charges from both cylinder chambers, so that these two strokes are limited to equal lengths and shaft turns.

U.S. Pat. No. 5,243,938, incorporated by reference herein, discloses a differential stroke piston apparatus for reciprocating internal combustion engines having a piston means disposed within a cylinder including an inner piston part which closes and seals the cylinder chamber and an outer piston part which serves as a carrier for the inner piston part and is connected to the engine shaft, preferably a crankshaft. The inner piston part is effective to operate on a cycle different from that of the outer piston, for example four strokes for the inner piston part and two strokes for the outer piston part per revolution of the engine. The present invention also provides a differential stroke cycle means to vary the stroke period and/or stroke length of the inner piston part cycle. The preferred embodiment provides a differential-four-stroke inner piston part and an outer piston part that is connected by a connecting rod to a crankshaft during the whole cycle. The two piston parts combine to ride on the connecting rod during the power and compression portions of the cycle, when compression forces are at their highest levels. During the exhaust and intake portions of the cycle, when compression forces are much lower, the inner piston part executes an inward and outward movements that are exhaust and intake respectively, independently of the outer piston part which continues to move connected to the connecting rod.

There is a need in the art for further accommodating (or softening, or cushioning) seating of the inner piston part and/or to adjust the piston seat height on the outer piston part.

OBJECT OF THE INVENTION

It is an object of the present invention to overcome or ameliorate at least one of the disadvantages of the prior art, or to provide a useful alternative.

It is an object of the invention in a preferred form to provide an accommodating piston seat for a differential-stroke cycle combustion engine.

SUMMARY OF THE INVENTION

According to a first aspect of the invention there is provided a piston seat apparatus for a differential-stroke cycle combustion engine, the combustion engine including one or more two-part pistons, each two-part piston having a first piston part and a second piston part, the apparatus comprising:

a piston seat cover operatively associated with the first piston part, the piston seat cover being adapted for abutting engagement with the second piston part;

wherein, upon abutting engagement, the seat cover is adapted to move relative to the first piston part, thereby at least partially absorbing impact forces applied between the first piston part and the second piston part.

Preferably, the piston seat cover is biased toward an extended position for receiving the abutting engagement. More preferably, the piston seat cover is biased by a compression spring.

Preferably, the first piston part and the second piston part move coaxially; and the piston seat cover is adapted to move in an axial direction with respect to the first piston part.

Preferably, the apparatus further comprises a piston seat cup coupled to the first piston part. More preferably, a piston seat cup is integrally formed with the first piston part. Most preferably, the piston seat cover is adapted to sealably slidingly engage the piston seat cup, thereby to define a sealed piston seat cavity.

Preferably, relative movement between the piston seat cover and the piston seat cup enables the piston seat cavity to have a variable volume.

Preferably, the apparatus further comprises a fluid ingress aperture and a fluid egress aperture for respectively enabling fluid to enter and to exit the piston seat cavity. More preferably, during a first predetermined period of operation of the combustion engine, fluid flow into the piston seat cavity is interrupted by closing the fluid ingress aperture, until fluid flow recommences. Most preferably, during a second predetermined period of operation, fluid out of the piston is interrupted by closing the egress aperture; thereby preserving a predetermined amount of fluid within the piston seat cavity volume, until fluid flow recommences.

Preferably, the piston seat cavity is fillable with engine oil during operation of the combustion engine.

Preferably, the first piston part is an outer piston part; and the second piston part is an inner piston apart.

According to a second aspect of the invention there is provided a piston seat apparatus for a differential-stroke cycle combustion engine, the combustion engine including one or more two-part pistons, each two-part piston having a first piston part and a second piston part, the apparatus comprising:

an accommodating seating means for accommodating dynamic contact force loading applied between the first piston part and the second piston part.

Preferably, the accommodating seating means includes a piston seat cover adapted for abutting engagement with the second piston part.

Preferably, the force loading being associated with pressures of at least one of the compression and combustion of gases within the combustion engine.

Preferably, the apparatus further comprises:

a height control means for controlling a seat height parameter associated with an operating distance between the first piston part and the second piston part during at least one portion of the a combustion cycle.

Preferably, the apparatus further comprises:

a height adjustment means for establishing an operating distance between the first piston part and the second piston part during a combustion cycle.

Preferably, the height adjustment means establishes an operating distance between the first piston part and the second piston part during the combustion cycle when the first piston part and second piston part are moving substantially in unison. More preferably, the height adjustment means further comprises a spring means.

Preferably, the apparatus further comprises a locking means for maintaining a set piston height. More preferably, the locking means maintains the set piston height while the first piston part and second position part remain in bearing contact.

According to a third aspect of the invention there is provided a method of absorbing impact forces applied between a first piston part and a second piston part of a two-part piston used in a differential-stroke cycle combustion engine, the method comprising the steps of:

(a) accommodating dynamic contact force loading applied between the first piston part and the second piston part;

(b) mitigating noise by the dynamic abutting between the first piston part and second piston part;

(c) establishing an operating distance between the first piston part and the second piston part during a first portion of a combustion cycle; and (d) maintaining the operating distance during a second portion of the combustion cycle.

According to an aspect of the invention there is provided an apparatus including a means and process for cushioning of impact and mitigation of noises, compression ratio height adjustment (during the compression cycle), and preserving adjusted height.

According to an aspect of the invention there is provided an apparatus for improved joining (or seating) of an inner piston part and an outer piston part when operating as two-part piston. The apparatus preferably comprises a piston seat located on the outer piston part, the piston seat being adapted to abuttingly accommodate the inner piston part during a seating process. Preferably, the piston seat is adapted to provide any one or more of the following including: cushioning impact force intensity; providing a resultant seating height; supporting the inner piston part while jointly compressing and resisting combustion pressure of the gas mixture in the cylinder.

According to an aspect of the invention there is provided a cushion means. The cushion means being adapted to reduce impact strength during the seating process.

According to an aspect of the invention there is provided a height-adjustment means. The height-adjustment means is preferably adapted to adjust the piston seat height for the combined piston height for gas compression.

Preferably, the cushion means and the height-adjustment means can be of one integral apparatus coupled to a piston seat. Alternatively, the cushion means and the height-adjustment means can be provided as two or more separate apparatuses coupled to a piston seat.

According to an aspect of the invention there is provided a locking means operatively associated with a height-adjustment means. Preferably, the locking means restricts the seat height variations after the height adjustment. More preferably, the locking means reduces yielding and vibrations of the piston seat under ignition pressure loading. Most preferably, the locking means substantially eliminates yielding and vibrations of the piston seat under ignition pressure loading.

According to an aspect of the invention there is provided an apparatus for improved joining (or seating) of an inner piston part and an outer piston part when operating as two-part piston for the differential-stroke cycle engine. Preferably, the apparatus includes a piston seat and is adapted to lessen (or soften) the seat loading of the inner piston part. More preferably, the apparatus is adapted to adjust the piston seat height relative to the outer piston part.

The inner piston part is preferably slidably movable with respect to the outer piston part. More preferably, inner piston part can move jointly with the outer piston part during a first portion of a combustion cycle, and separately from the outer piston part during a second portion of the combustion cycle.

The apparatus preferably comprises any one or more of: a cushion means to lessen the impact; a height adjustment means for adjusting piston seat height under pressure; and a locking means for temporarily fixing the piston seat at a desired seat height during a third portion of the combustion cycle.

According to an aspect of the invention, there is provided a piston seat apparatus for a differential-stroke cycle combustion engine, substantially as herein described with reference to the accompanying drawings.

According to an aspect of the invention, there is provided a method of absorbing impact forces applied between a first piston part and a second piston part of a two-part piston used in a differential-stroke cycle combustion engine, substantially as herein described with reference to the accompanying drawings.

BRIEF DESCRIPTION OF THE DRAWINGS

A preferred embodiment of the invention will now be described, by way of example only, with reference to the accompanying drawings in which.

PREFERRED EMBODIMENT OF THE INVENTION

Figure 1:
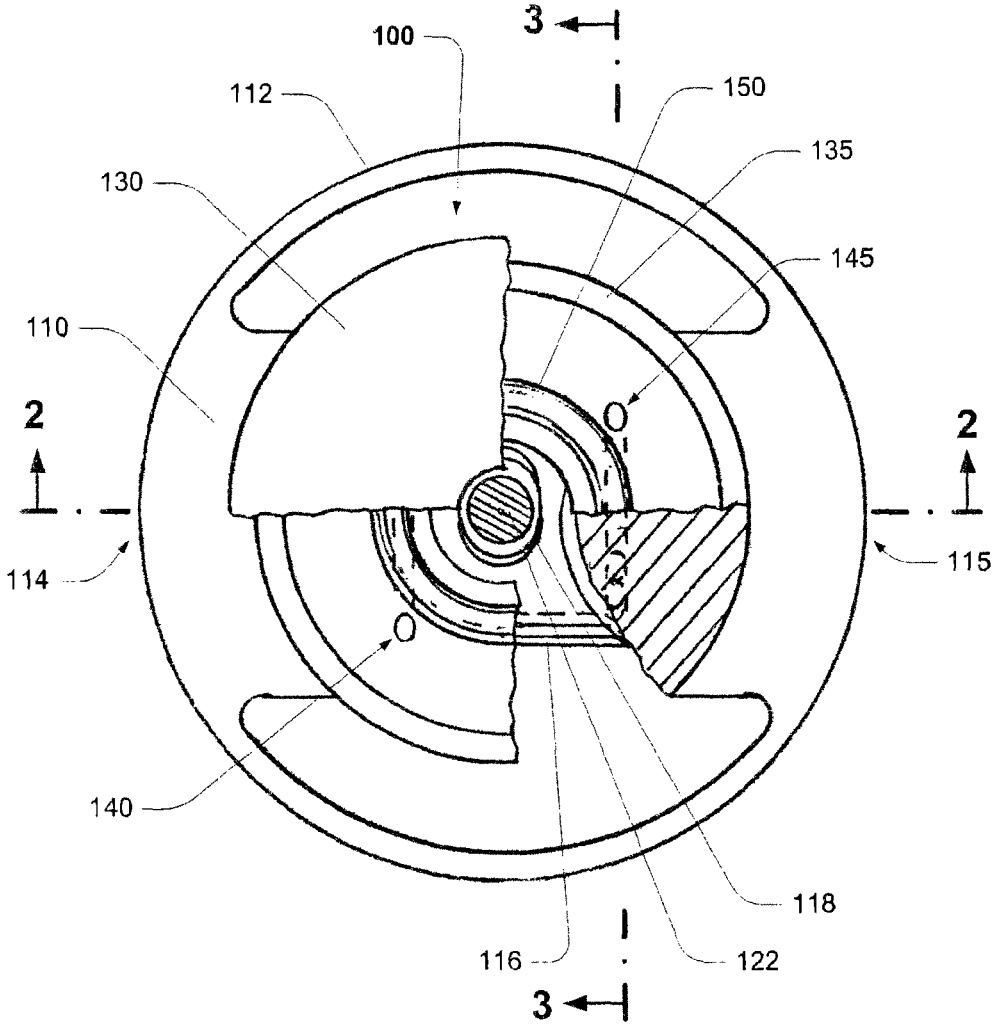
FIG. 1 is a top view of an embodiment piston seat apparatus according to the invention.

A differential-stroke cycle engine employs a two-part piston to complete the four-stroke thermal cycle in every engine revolution. The two-part piston comprises an outer piston part and an inner piston part.

It will be appreciated that, conventional piston engines (2-cycle or 4-cycle), use a piston to perform two functions. Those functions are to seal the chamber and to transmit forces between the chamber and the crankshaft. An alternative is to separate these two functions using a two-part piston, consists of an inner piston part and an outer piston part, as used in a D-cycle (differential-stroke cycle) engine.

The inner piston part seals the chamber and acts like an air pump to assist gases in and out of the chamber in exhaust and intake strokes of the 4-stroke cycle process—moving separately from the outer part. During heavy-load strokes, of combustion or compression, the inner piston part is seated on and supported by the outer part.

There will be a "perceived impact" when the inner piston part is being seated to the outer piston part after the intake stroke (similar to valve seating in a valve-train) to compress the gases. Similar impact "issues" exist in valve seating associated with a valve-train. The valve seating noise was noticeable in the older vehicles. The valve-train impact issue has been mitigated by a series of improvements including better cam design and hydraulic lifters. The valve seating noise is relatively non-existent today.

To "cushion" the piston impact to an acceptable level can involve cam design and hydraulic lifters.

It will also be appreciated that, efficiency of the internal combustion engine is proportional to the compression ratio, which is the ratio between the chamber volumes at the beginning and end of the compression stroke. Typically, the higher the compression ratio, the better the engine efficiency is. One way to increase the ratio is to reduce the volume at the end of the stroke, i.e. the dome volume on top of the piston. That is to push the piston top deeper into the engine head region. As shown herein, use of a spring and locking means (or mechanism) enables adjustment of a seat height for achieving a better compression ratio (properly positioned before engine knock in gasoline engines). Preferably, the lock mechanism is a hydraulic lock, whereby fluid is sealed in a fixed volume, to retain its volume and define a piston seat height under pressure. The spring constant and gas dynamic pressure in the chamber automatically act as the force and counter force to position the spring as a cavity volume is sealed, thereby providing an automatic variable-compression-ratio piston seat.

A piston seat apparatus can provide engine noise reduction and improved engine efficiency. The automatic compression ratio can further enhance the already high efficiency of the engine. The cushion seating can reduce the objectionable noises in the engines.

In an embodiment, the outer piston part is typically pivotally coupled via a piston pin to a connection rod, which is further coupled to an engine shaft in the conventional manner.

In an embodiment, the inner piston part typically has piston rings there around and is operated by a piston stem which is slidably coupled to the outer piston part. The piston stem is typically coupled proximal to underneath the inner piston part and is adapted to extend throughout the outer piston part.

In an embodiment, an inner piston part can be actuated and driven by a lever means attached at the distal end of a respective piston stem to facilitate the completion of the four strokes. By way of example only, an inner piston part can be actuated and driven in accordance with the teaching of U.S. Pat. No. 5,243,938.

It will be appreciated that both the inner piston part and the outer piston part co-axially slide within a cylinder bore, and along the cylinder axis. The inner piston part and the outer piston part can move, dependant on the piston stroke crank angle, within the cylinder wall either jointly or separately.

A piston seat apparatus can be located proximal to (typically coupled to) the outer piston, and adapted to engage and support the inner piston part while the two piston parts move jointly.

It will be appreciated that, when the inner piston part and the outer piston part are brought together, an impact may result that can cause structural damage and/or produce undesirable noises. Therefore, there is a desire to lessen (or soften) the impact with a cushion means. The cushion means can be allied to the piston seat apparatus.

It will also be appreciated that, when the inner piston part and the outer piston part jointly compresses gases in the cylinder chamber (prior to ignition), higher magnitude of compression will result in higher efficiency of the combustion engine operations. Therefore, there is a desire to raise the piston seat height to increase the compression ratio.

It should also be appreciated that, when the inner piston part and the outer piston part jointly compresses gases in the cylinder chamber (prior to ignition), the strength of compression may result in undesirably high component stresses or damaging knocking by the fuel mixture of the spark-ignition engines. Therefore, there is also a desire to regulate the piston seat height for compression ratio adjustment.

FIG. 1 shows, by way of example only, the top view of an embodiment piston seat apparatus. This view shows an outer piston part having a piston seat apparatus comprising an piston seat cover (three quarters sectioned for clarity) and a piston seat cup (one quarter sectioned for clarity). This view also shows the outer piston part to include a piston skirt. An inner piston part (not shown) is slidably movably coupled to the outer piston part by a piston stem. Sliding movement of the inner piston part with respect to the outer piston part brings the inner piston part unto abutting engagement with the piston seat cover.

Referring to FIG. 1, an embodiment piston seat apparatus 100 for a differential-stroke cycle combustion engine, can be operatively associated with an outer piston part 110. By way of example only, the outer piston part can define a piston skirt 112, which slides along a cylinder wall during use. The outer piston part further includes a pair of piston pin housings 114 and 115.

In this example, the outer piston part is pivotally connected to a connecting rod 116 by a piston pin 117 which is housed in the piston pin housings 114 and 115. In this configuration, the connecting rod can swing back and forth across the piston axis as the crankshaft rotates around the engine axis in a conventional manner.

An inner piston part 120 (not shown) can be slidably coupled to the outer piston part by a piston stem 122. The inner piston part can abutting engage the outer piston part.

The piston stem 122 (show with the respective inner piston cut away for clarity), passes through the outer piston part and through a connecting rod 116. The connecting rod has an aperture 118 in the "small end" which enables the connecting rod it to swing back and forth without interfering with the piston stem 122.

A piston seat apparatus can be used to at least partially absorb impact forces applied between the first piston part and second piston part.

In an embodiment, a piston seat apparatus 100, includes a piston seat cover 130 (shown partially sectioned with three quarter removed for clarity), a piston seat cup 135 (shown partially sectioned with one quarter removed for clarity), and a piston seat spring 150 (shown partially sectioned with one quarter removed for clarity).

By way of example, the piston stem 122 guides the inner piston part (broken away for clarity, not shown) to sit on the piston seat cover 130. This typically occurs when both piston parts move jointly under pressure applied by a combustion chamber (not shown). The piston seat spring 150 is provided to counter the gaseous pressure applied by the combustion chamber. This gas pressure compresses the seat spring to a reaction height. The spring rate can be selected to supports the piston seat cover 130. The piston seat cover is adapted to sealable slidingly engage the piston seat cup, thereby to define a sealed piston seat cavity.

In this embodiment, a fluid ingress aperture 140 and a fluid egress aperture 145 are located within the piston seat cup 135 for enabling fluid (preferably engine oil) to circulate into and out of the piston seat cavity.

In an embodiment, a piston seat apparatus 100 is provided for a differential-stroke cycle combustion engine, the combustion engine including one or more two-part pistons, each two-part piston having an outer piston part 110 and an inner piston part (120, not shown). The apparatus comprising a piston seat cover 130 operatively associated with the outer piston part, the piston seat cover being adapted for abutting engagement with the inner piston part; wherein, upon abutting engagement, the seat cover is adapted to move relative to the outer piston part, thereby at least partially absorbing impact forces applied between the outer piston part and the inner piston part.

Figure 2:
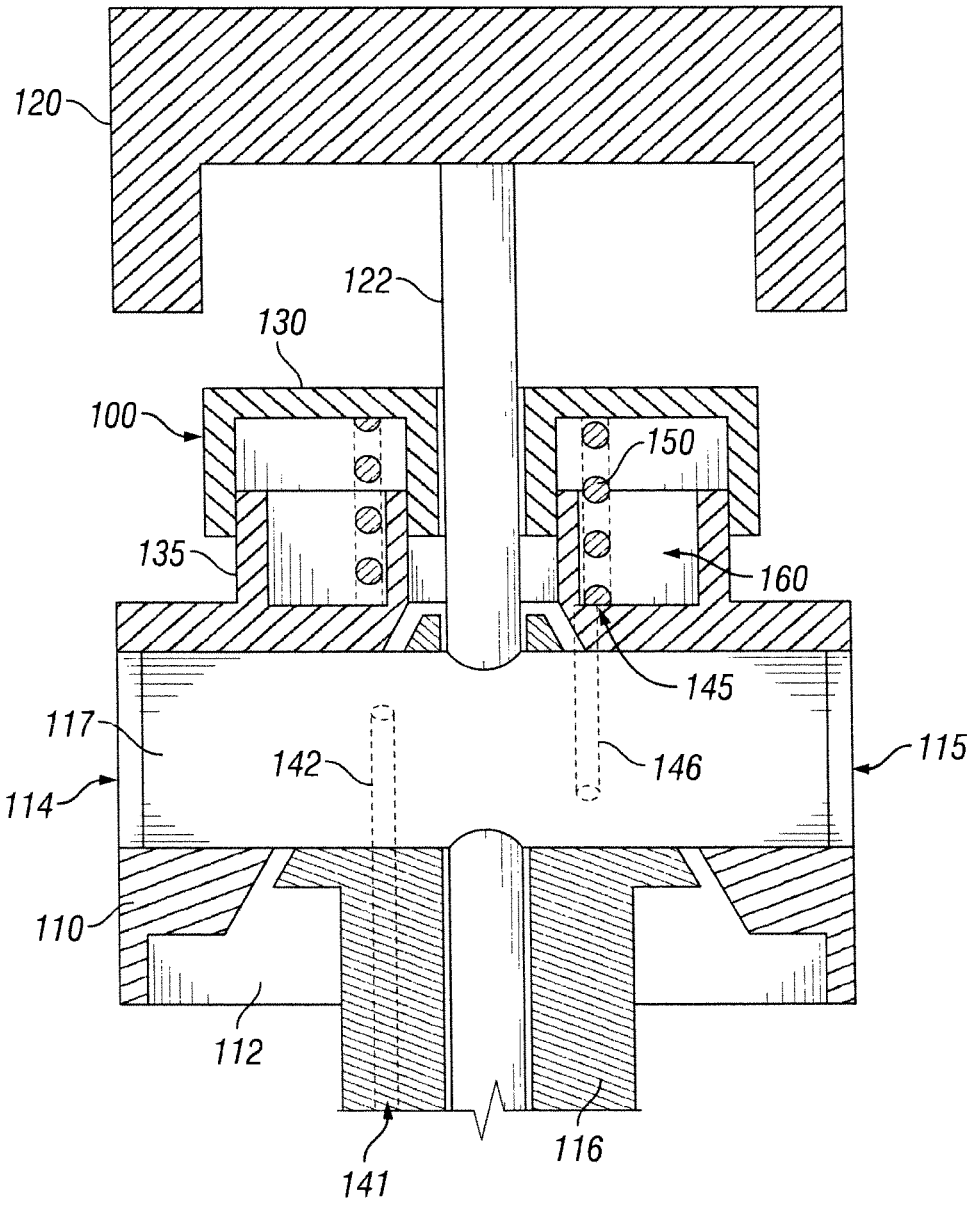
FIG. 2 is a partial sectional side view of the apparatus of FIG. 1, taken along line 2-2.

FIG. 2 shows a side sectional view, partially broken away through line 2-2 (along the piston pins axis) of FIG. 1. In this figure the inner piston is broken-away from the piston stem.

Referring to FIG. 2, the piston seat cover 130 is in sliding engagement over the piston seat cup 135, thereby defining a sealed piston seat cavity 160. It will be appreciated that the volume of the cavity 160 can be varied by relative movement between the piston seat cover 130 and the piston seat cup 135. This cavity can be filled with fluid (preferably engine oil) during operation.

In this embodiment, a fluid ingress aperture 140 and a fluid egress aperture 145 are located within the piston seat cup 135 for enabling fluid (preferably engine oil) to circulate into and out of the piston seat cavity.

In an embodiment, fluid (preferably engine oil) can be provided to the fluid ingress aperture 140 through a cooperating rod passage 141 and cooperating piston pin inlet passage 142. It will be appreciated that, in this example, the rod passage 141 and piston pin inlet passage 142 are only in fluid communication for a portion of the combustion cycle, at which time fluid can flow into the piston seat cavity 160.

In an embodiment, fluid (preferably engine oil) can also drain from the cavity 160 via the fluid egress aperture 145 through a cooperating piston pin outlet passage 146 (located in the piston pin 117) and a cooperating outlet opening 147 (located in the connecting rod small end). It will be appreciated that, in this example, the pin egress passage 146 and egress opening 147 in the small end of the connecting rod are in fluid communication for only a portion of the combustion cycle, at which time fluid can drain from the piston seat cavity 160.

Figure 3:
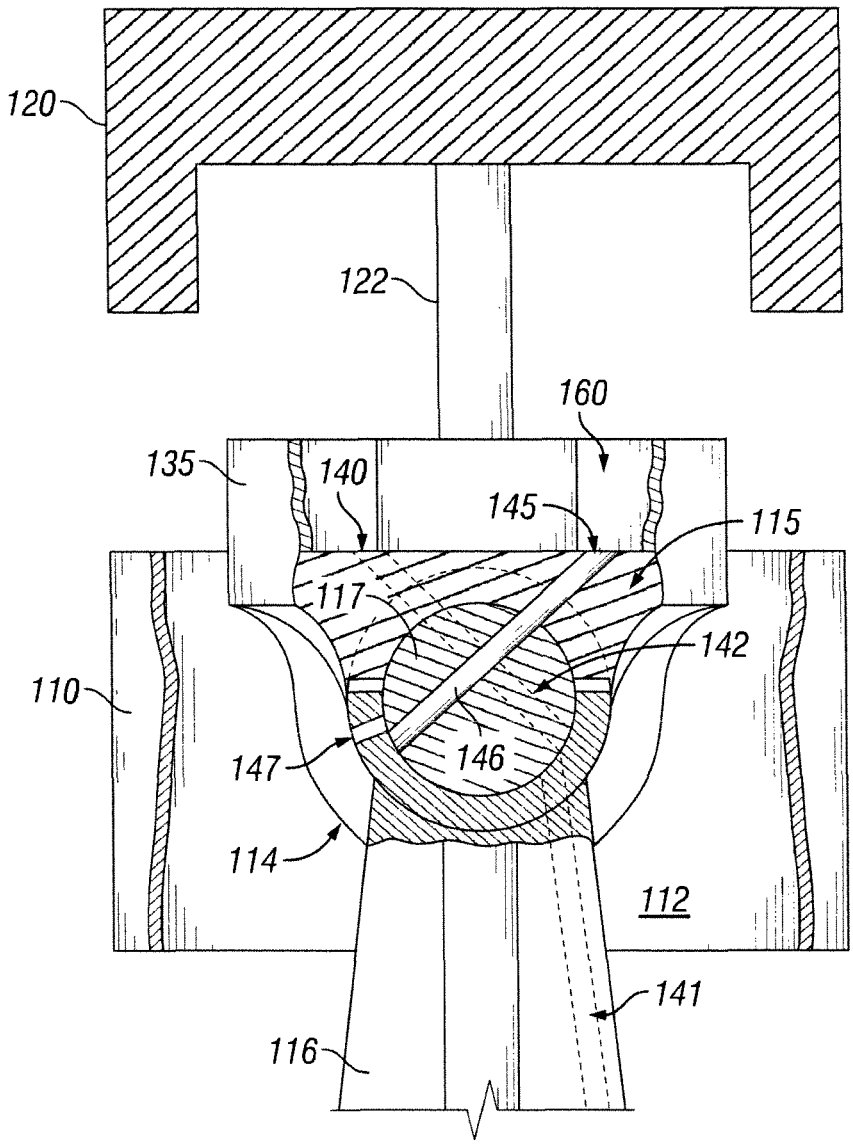
FIG. 3 is a partial sectional side view of the apparatus of FIG. 1, taken along line 3-3.

FIG. 3 shows a side sectional view, taken along line 3-3 of FIG. 1, showing the connecting rod at the top-dead-center position. In this view, for clarity, the piston seat cover and piston spring have been removed, and the lower portion of one leg of the split connecting rod 116 has been broken away.

Referring to FIG. 3, by way of example, the connecting rod 116 is pivotally connected to the piston pin 117, enabling the connecting rod to swing back and forth across the piston axis as the crankshaft rotates around the engine axis in a conventional manner.

In an embodiment, a fluid egress opening 147 (located in the connecting rod small end) permits the fluid to drain from the cavity 160, when the egress passage comes into alignment (fluid communication) with the piston pin egress passage 146. This fluid communication occurs each combustion cycle as the connecting rod swings—and can be strategically synchronized to occur at a predetermined period (in timing and duration) of the combustion cycle.

In an embodiment, a connecting rod passage 141 and piston pin ingress passage 142 enables fluid (preferably engine oil) to flow into the piston seat cavity 160.

It will be appreciated that this provides a means of height control for controlling a seat height parameter associated with an operating distance between the first piston part and the second piston part during at least one portion of the a combustion cycle.

It will be further appreciated that, as the rod swings relative to the outer piston part (or piston pin 117), fluid flow is interrupted as both the ingress and egress passages are closed. In this situation, fluid currently held in the piston cavity maintains a cavity volume unchanged until the fluid starts to flow. This provides a means of locking for maintaining a set piston height. Typically, fluid flow is interrupted (thereby a locking means enabled) while the first piston part and second position part remain in bearing contact.

In an embodiment, the flow of fluid is interrupted as the crankshaft rotates near the top dead centre, thereby to hold the piston seat at a desired height for the combustion until the end of combustion and the first piston part is lifted from the piston seat as the second piston part continue toward near the bottom dead centre, and the connecting rod swings to the counter-clockwise side (referring to FIG. 3) of the piston and cylinder axes.

Figure 4:
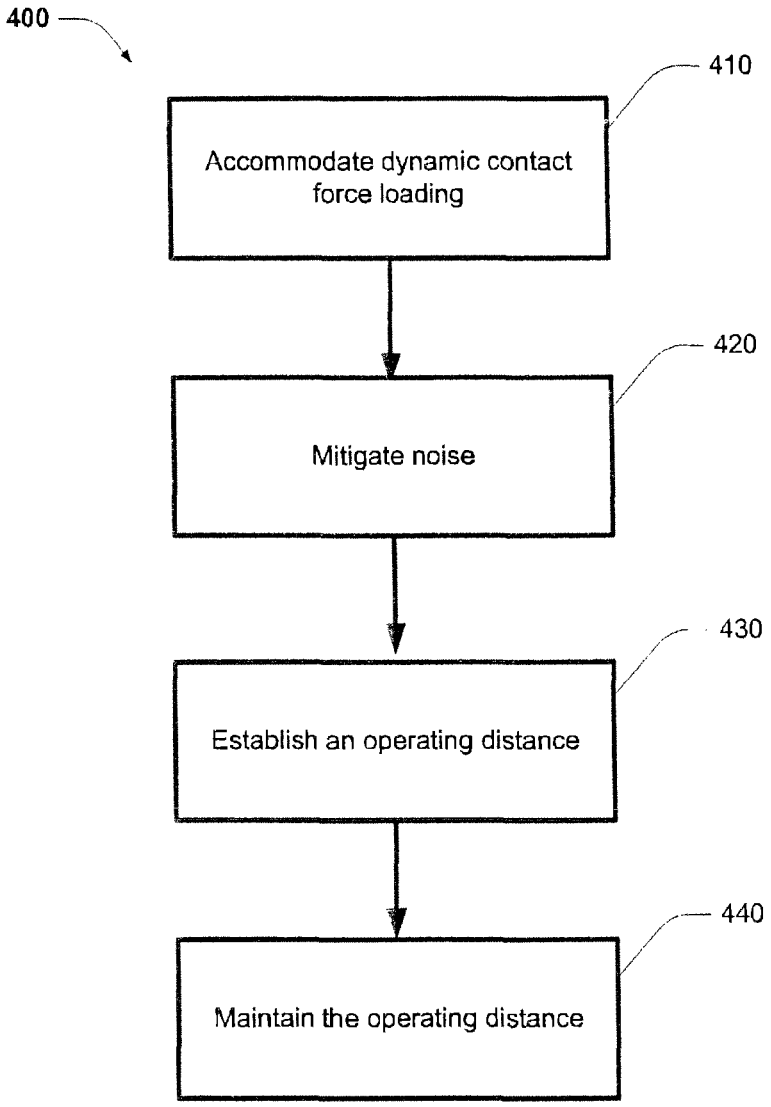
FIG. 4 is a flowchart for an embodiment method according to the invention.

Referring to FIG. 4, an embodiment method 400 is disclosed for absorbing impact forces applied between an outer piston part and an inner piston part of a two-part piston used in a differential-stroke cycle combustion engine. By way of example, the method comprises:

STEP 410: accommodating dynamic contact force loading applied between the outer piston part and the inner piston part;

STEP 430: establishing an operating distance between the outer piston part and the inner piston part during a first portion of a combustion cycle; and STEP 440: maintaining the operating distance during a second portion of the combustion cycle.

In an embodiment, an accommodating seating means for a two-part piston can be used to cushion the impact between outer and inner piston parts. The accommodating seating means is adapted to cushion or soften impact between outer and inner piston parts.

In an embodiment, an accommodating seating means for a two-part piston can be used to mitigate the impact noise between outer and inner piston parts. The method can further comprise STEP 420: of mitigating noise by the dynamic abutting between the first piston part and second piston part, as best shown in FIG. 4. The accommodating seating means is adapted to mitigate the noise between outer and inner piston parts.

The operating distance between the outer piston part and the inner piston part "seat height" can be adjusted for controlling the compression ratio, particularly when the parts of the two-part piston come together and move in unison to compress the fuel charge for combustion. The outer piston part is adapted to support the inner piston part. The outer piston part and the inner piston part can move in unison and separately, thereby to define different stroke lengths and periods. A height adjustment means is adapted to adjust seat height under gaseous compression and to retain the optimal seat height during combustion. In an embodiment, an accommodation apparatus is taught for improved joining of the two parts of and operation of the joint two-part piston. A piston seat on the outer piston part accommodates the inner piston part during the seating process and cushions the force intensity and, with proper resultant seating height, supports the inner piston part to jointly compress the gas pressure and resist the ignition when the outer and inner parts moves jointly in the cylinder.

In an embodiment, a cushion means and height-adjustment means of the piston seat is taught. The cushion means is adapted to soften the impact during the seating process. The height-adjustment means is adapted to adjust the piston seat height for the combined piston height for gas compression. In this example, the cushion means and the height-adjustment means can be of one integral apparatus or two separate apparatuses of the piston seat. It will be appreciated that a cushion means and height-adjustment means can be provided as a spring complemented by the hydraulic control disclosed herein. The spring has a preset spring rate that yields under loading and achieves a desirable height under load.

In another embodiment, a locking means can be provided for a height-adjustment means. This locking means restricts the seat height variations after the height adjustment. The locking means restrict the seat yielding and vibrating under ignition pressure loading. Hydraulic locking provides further control over the spring responses and reduces (or substantially mitigates) vibration. Under dynamic loadings the spring may exhibit undesirable vibrations, which can be reduced (or mitigated) by the hydraulic control via fluid (preferably oil) flow. Hydraulic means further comprises a cavity (or chamber) with a flow regulation for regulating fluid flow to and from the cavity. Flow regulation further comprises a locking means to lock the piston seat at a desired height.

In an embodiment, fluid flow regulation can be provided be one or more fluid passages. The fluid passages provide flow paths through the connecting rod and the piston pin into the piston seat cavity. An advantage includes automatic flow rate control provided by the design of the paths and the interruption of flow by the relative movement of the connection rod. In particular, strategically located passage locations and sizes between the pin and the connection rod can be used. The matching passages between the pin and connection rod define a flow control means and a locking means.

In an embodiment, an accommodating seat apparatus can comprise, an accommodating seating means having a fluid cavity (or chamber) adapted for retaining a fluid and a control means operable to vary chamber height, wherein the chamber height being effected in responding to loadings on a two-part piston and/or between respective two piston parts.

By way of example only, the chamber height control means can be operable by receiving fluid from and discharging fluid into passages defined in the outer piston part. These passages being located to control the chamber height during preset portion of a combustion cycle. The chamber height control means can also be operable to discharge fluid from the cavity. The seat height control means can also be operatively associated with the rotation of crankshaft to provide a seat height control parameter during a combustion cycle. The seat height control means can also be located, in part, through the pin of a two-part piston.

It will be appreciated that an illustrated embodiment discloses a piston seat for cushioning the seating of the inner piston part, adjusting the piston height for compression ratio control, and maintaining the seat height to resist combustion pressure. The interruption of fluid flows can be synchronized, or somewhat offset, to better control of the seat height for compression ratio adjustment before combustion. During the remainder of the connecting rod swing, fluid passages are typically open to allow fluid to flow into and fill the seat cavity. A spring is used to cushion the seating of the inner piston part, and to accommodate—by spring height—for the gas pressure during the compression of the gas in the combustion chamber.

Advantages over the prior art have been disclosed. For example, an accommodation means can provide any one or more of the following:

cushion the seating dynamic loadings to reduce contact noises and impact strength of the piston parts;

adjust the seat height of the piston parts improve control over the compression of the gases to obtain greater overall engine efficiency; and reduce possibility for fuel mixture knocking.

In an embodiment, an accommodating apparatus (or piston seat apparatus) can include a viscous-elastic material means. The viscous-elastic material has different dynamic properties responding to different rate of dynamic loadings, which can be more viscous or more elastic or a shade of both. There is a transition rate of loading range which separates the material being more viscous or more elastic. When loaded at very high rate such as the ignition of charged fuel mixture, a viscous material can exhibit high resistance forces and maintains the height of such material. An ignition rate is of order of magnitude higher than that of the compression rate by the piston speeds. An accommodating apparatus can include an appropriately formulated and designed viscous-elastic material.

The present invention provides several advantages over the prior art. The accommodation means cushions the seating dynamic loadings and adjusts the seat height in order to mitigate contact noises of the piston parts and to provide better control over the compression of the gases to obtain greater overall engine efficiency and reduced possibility for fuel mixture knocking.

While the present preferred embodiments and practices of the invention have been illustrated and described, it will be understood that the invention may be otherwise embodied and practices within the scope of the following claims. Although the invention has been described with reference to specific examples, it will be appreciated by those skilled in the art that the invention may be embodied in many other forms.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

Similarly, it is to be noticed that the term coupled, when used in the claims, should not be interpreted as being limitative to direct connections only. The terms "coupled" and "connected," along with their derivatives, may be used. It should be understood that these terms are not intended as synonyms for each other. Thus, the scope of the expression a device A coupled to a device B should not be limited to devices or systems wherein an output of device A is directly connected to an input of device B. It means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

Similarly it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Furthermore, some of the embodiments are described herein as a method or combination of elements of a method that can be implemented by a processor of a computer system or by other means of carrying out the function. Thus, a processor with the necessary instructions for carrying out such a method or element of a method forms a means for carrying out the method or element of a method. Furthermore, an element described herein of an apparatus embodiment is an example of a means for carrying out the function performed by the element for the purpose of carrying out the invention.

In the description provided herein, numerous specific details are set forth. However, it is understood that embodiments of the invention may be practiced without these specific details. In other instances, well-known methods, structures and techniques have not been shown in detail in order not to obscure an understanding of this description.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. For example, any formulas given above are merely representative of procedures that may be used. Functionality may be added or deleted from the block diagrams and operations may be interchanged among functional blocks. Steps may be added or deleted to methods described within the scope of the present invention.

What is claimed is:

1. A piston seat apparatus for a differential-stroke cycle combustion engine, the combustion engine including one or more two-part pistons, each two-part piston having a first piston part and a second piston part that moves separately from the first piston part during exhaust and intake strokes of the engine, the apparatus comprising:

a piston seat cover operatively associated with the first piston part, the piston seat cover being adapted for abutting engagement with the second piston part, wherein, upon abutting engagement, the piston seat cover is adapted to move relative to the first piston part thereby at least partially absorbing impact forces applied between the first piston part and the second piston part;

a piston seat cup coupled to the first piston part, wherein the piston seat cover is adapted to sealably slidingly engage the piston seat cup, thereby to define a sealed piston seat cavity;

a fluid ingress aperture in alignment with a cooperating piston rod passage and piston pin inlet for a portion of a combustion cycle of the engine, thereby allowing fluid to enter the piston seat cavity; and a fluid egress aperture in alignment with a cooperating piston pin passage and piston rod outlet for a portion of the combustion cycle of the engine, thereby allowing fluid to exit the piston seat cavity, wherein during a first predetermined period of operation of the combustion engine, fluid flow into the piston seat cavity is interrupted by misaligning the piston rod passage and piston pin inlet and closing the fluid ingress aperture; and wherein during a second predetermined period of operation, fluid out of the piston is interrupted by misaligning the piston pin passage and piston rod outlet and closing the egress aperture; thereby preserving a predetermined amount of fluid within the piston seat cavity volume, until fluid flow recommences.

2. The apparatus according to claim 1, wherein:

the first piston part and the second piston part move coaxially; and the piston seat cover is adapted to move in an axial direction with respect to the first piston part.

3. The apparatus according to claim 1, wherein:

the piston seat cup is integrally formed with the first piston part.

4. The apparatus according to claim 1, wherein:

relative movement between the piston seat cover and the piston seat cup enables the piston seat cavity to have a variable volume.

5. The apparatus according to claim 1, wherein:

the piston seat cavity is fillable with engine oil during operation of the combustion engine.

6. The apparatus according to claim 1, further comprising a piston seat spring disposed within the piston seat cavity configured to bias the piston seat cover in a first direction.

7. The apparatus according to claim 6, wherein during a third predetermined period of operation, the second piston part abuts the piston seat cover and moves the piston seat cover toward the first piston part, thereby compressing the piston seat spring and reducing the piston seat cavity volume.

8. The apparatus according to claim 7, wherein during a fourth predetermined period of operation, fluid flow is interrupted as both the ingress and egress apertures are closed thereby maintaining a piston seat cavity volume unchanged until fluid flow through either the ingress or egress aperture recommences.

9. A piston seat apparatus for a differential-stroke cycle combustion engine, the combustion engine including one or more two-part pistons, each two-part piston having a first piston part and a second piston part operated by a piston stem which is slidably coupled to the first piston part, the apparatus comprising:

a piston seat cover operatively associated with the first piston part, the piston seat cover being adapted for abutting engagement with the second piston part, wherein, upon abutting engagement, the piston seat cover is adapted to move relative to the first piston part thereby at least partially absorbing impact forces applied between the first piston part and the second piston part;

a piston seat cup coupled to the first piston part, wherein the piston seat cover is adapted to sealably slidingly engage the piston seat cup, thereby to define a sealed piston seat cavity;

a fluid ingress aperture in alignment with a cooperating piston rod passage and piston pin inlet for a portion of a combustion cycle of the engine, thereby allowing fluid to enter the piston seat cavity; and a fluid egress aperture in alignment with a cooperating piston pin passage and piston rod outlet for a portion of the combustion cycle of the engine, thereby allowing fluid to exit the piston seat cavity.

10. The apparatus according to claim 9, wherein:

the first piston part and the second piston part move coaxially and the piston seat cover is adapted to move in an axial direction with respect to the first piston part.

11. The apparatus according to claim 9, wherein:

the piston seat cup is integrally formed with the first piston part.

12. The apparatus according to claim 9, wherein:

relative movement between the piston seat cover and the piston seat cup enables the piston seat cavity to have a variable volume.

13. The apparatus according to claim 9, wherein:

during a first predetermined period of operation of the combustion engine, fluid flow into the piston seat cavity is interrupted by misaligning the piston rod passage and piston pin inlet and closing the fluid ingress aperture; and during a second predetermined period of operation, fluid out of the piston is interrupted by misaligning the piston pin passage and piston rod out let and closing the egress aperture; thereby preserving a predetermined amount of fluid within the piston seat cavity volume, until fluid flow recommences.

14. The apparatus according to claim 9, further comprising a piston seat spring disposed within the piston seat cavity configured to bias the piston seat cover in a first direction.

15. The apparatus according to claim 9, wherein during a third predetermined period of operation, the second piston part abuts the piston seat cover and moves the piston seat cover toward the first piston part, thereby compressing the piston seat spring and reducing the piston seat cavity volume.

16. The apparatus according to claim 15, wherein during a fourth predetermined period of operation, fluid flow is interrupted as both the ingress and egress apertures are closed thereby maintaining a piston seat cavity volume unchanged until fluid flow through either the ingress or egress aperture recommences.

17. The apparatus according to claim 9, wherein preserving the predetermined amount of fluid within the piston seat cavity volume determines a piston seat cover height relative to the first piston part.

* * * * *